US008327476B1

(12) United States Patent
Paratore

(10) Patent No.: US 8,327,476 B1
(45) Date of Patent: Dec. 11, 2012

(54) BEACH TOWEL WITH ANCHORING MEANS

(76) Inventor: Anna Marie Paratore, Albany, NY (US)

( * ) Notice: Subject to any disclaimer, the term of this patent is extended or adjusted under 35 U.S.C. 154(b) by 0 days.

(21) Appl. No.: 13/016,247

(22) Filed: Jan. 28, 2011

Related U.S. Application Data

(60) Provisional application No. 61/299,026, filed on Jan. 28, 2010.

(51) Int. Cl.
*A47G 9/06* (2006.01)

(52) U.S. Cl. ..... 5/420; 5/417; 5/656

(58) Field of Classification Search ..... 5/417–420, 5/691, 413 R, 656, 659; D6/608
See application file for complete search history.

(56) References Cited

U.S. PATENT DOCUMENTS

| | | | | |
|---|---|---|---|---|
| 3,226,737 | A * | 1/1966 | Rote | 5/417 |
| 3,237,904 | A | 3/1966 | Abruzese | |
| 4,272,575 | A | 6/1981 | Egigian | |
| 4,654,906 | A * | 4/1987 | Roberts | 5/417 |
| 5,150,485 | A | 9/1992 | Maguire | |
| 5,156,339 | A * | 10/1992 | Gibson et al. | 239/289 |
| 5,176,354 | A | 1/1993 | Feigenbaum, Jr. | |
| 5,226,184 | A * | 7/1993 | Cheng | 5/417 |
| 5,353,453 | A * | 10/1994 | Naumann | 5/417 |
| D379,129 | S | 5/1997 | Yost et al. | |
| 5,809,700 | A | 9/1998 | Roush et al. | |
| 5,966,757 | A * | 10/1999 | Sullivan | 5/417 |
| 6,192,536 | B1 * | 2/2001 | Connors | 5/417 |
| D439,463 | S | 3/2001 | Bare | |
| 6,226,813 | B1 | 5/2001 | Wilburn et al. | |
| 6,266,813 | B1 * | 7/2001 | Ihara | 725/36 |
| 6,631,527 | B2 | 10/2003 | Hyduk | |
| D653,490 | S * | 2/2012 | Steinmann | D6/603 |
| 2005/0005355 | A1 * | 1/2005 | Marks et al. | 5/417 |
| 2008/0127414 | A1 * | 6/2008 | Allen | 5/417 |

* cited by examiner

*Primary Examiner* — William Kelleher
(74) *Attorney, Agent, or Firm* — Montgomery Patent & Design LLC; Robert C. Montgomery; Joe Yaksich

(57) ABSTRACT

A modular beach towel with an integral anchoring means designed to help keep the towel from blowing away while in use comprising additional enhancements is herein disclosed. The beach towel further comprises a plurality of grommets located along corner and perimeter areas. Each grommet receives a stake, thereby holding the beach towel down to a ground surface. The beach towel is fabricated of a layered textile assembly with internal cushioning, further having a removable protective waterproof mat and an attachable food and drink holder. The beach towel apparatus also comprises reflective zippered pouches at each corner position that provide storage of personal items as well as aiding in identifying the towel from a distance. The corner pouches may also be loaded with sand or weights to provide additional anchoring.

17 Claims, 4 Drawing Sheets

BEACH TOWEL WITH ANCHORING MEANS

RELATED APPLICATIONS

The present invention was first described in and claims the benefit of U.S. Provisional Application No. 61/299,026 filed Jan. 28, 2010, the entire disclosures of which are incorporated herein by reference.

FIELD OF THE INVENTION

The present invention relates generally to beach towels, and in particular, to a modular beach towel including a plurality of removably attachable portions.

BACKGROUND OF THE INVENTION

Very few leisure time activities rival that of spending a warm summer day at the beach. Whether the beach is at an ocean or a small lake, the feeling that comes with being outside and near water is enjoyable. Most people usually lie upon a large beach towel when at a beach. Such towels help to insulate them from the ground and keep the user clean and comfortable.

One (1) problem associated with using such towels is that they are prone to blowing away when no one is sitting on them. Even if people are sitting or lying upon them, the slightest breeze can cause corners to blow up and over, forcing a continuous and never ending battle to keep them down by weighting them with shoes, books, purses and the like. Additionally, such cloth towels have a number of other commonly encountered problems. For example, they do not provide any protection from water, which is often present at the ocean or lake. Also, towels do not make good barriers from sand and other environmental conditions which can be detrimental to both the beachgoer and their possessions.

Various attempts have been made to provide towels with additional accessories such as anchoring assemblies. Examples of these attempts can be seen by reference to several U.S. patents such as U.S. Pat. No. 3,237,904; U.S. Pat. No. 4,272,575; U.S. Pat. No. 5,150,485; U.S. Pat. No. 5,809,700; U.S. Pat. No. 6,226,813; and U.S. Pat. No. 6,631,527.

Additionally, ornamental designs for such a towel exist, particularly U.S. Pat. Nos. D 379,129 and D 439,463. However, none of these designs are similar to the present invention.

While these devices fulfill their respective, particular objectives, each of these references suffer from one (1) or more of the aforementioned disadvantages. Many such devices are difficult to install or remove and do not provide a sufficient level of stability once installed. Also, many such devices do not provide a sufficient range of storage, security, protection, and comfort for both a user and their personal effects. Furthermore, many such devices are not adjustable or customizable to accommodate various situations, locations, and preferences. In addition, many such devices do not allow a user to take advantage of the sunny conditions often found at a beach. Accordingly, there exists a need for a beach towel without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a beach towel providing a full range of comfort, protection, and customizability including stability and secure containment of personal items on a sand surface. Thus, the object of the present invention is to solve the aforementioned disadvantages and provide for this need.

To achieve the above objectives, it is an object of the present invention to provide a range of modular capabilities and configurations particularly adapted for beneficial employment at a beach, i.e. on a sand surface and in sunny conditions.

Another object of the present invention is to comprise a multi-layer towel assembly including a plurality of removably attachable layers providing a range of functionality. The towel assembly includes an upper towel surface, an internal cushioning batting layer, a reflective lower towel surface, and a removably attachable ground mat.

Yet still another object of the present invention is to provide a comfortable fabric laying or resting surface. The upper towel surface is constructed of a terrycloth material similar to a common beach towel. The internal cushioning batting layer is located between the upper towel surface and lower towel surface and functions as a pad to enable comfortable resting upon the apparatus on any surface.

Yet still another object of the present invention is to provide stable anchoring of the apparatus using a plurality of stakes. The towel assembly also includes a plurality of grommets around a perimeter edge which align through the upper towel surface, the lower towel surface, and the ground mat and correspondingly receive the stakes. In this manner, the user can drive the stakes through a desired plurality of grommets into a ground surface to hold the apparatus in place during use.

Yet still another object of the present invention is to facilitate installation and further secure the device by comprising each stake of an over-sized stake head including a large, flat area. The stake head provides a large area on which to strike the stake with a mallet or the like during installation, and provides additional contact with the ground surface upon installation.

Yet still another object of the present invention is to provide waterproof protection from wet or dirty ground surfaces by constructing the ground mat of a waterproof material such as plastic or rubber sheet. The mat is removably attachable from the lower towel surface using a plurality of hook-and-loop-type fasteners.

Yet still another object of the present invention is to provide storage and protection for personal effects within a plurality of corner pouches. Each pouch comprises a triangular pocket affixed to the towel assembly at a corner position. Each pouch further comprises an inwardly facing zipper which enables the user to both securely enclose an object within the pouch and which conceals the presence of the pouch from passersby.

Yet still another object of the present invention is to enable a user to provide additional stabilization of the corners of the towel assembly by filling the pouches with a weighted material such as sand.

Yet still another object of the present invention is to harness sunlight to good effect by comprising the lower towel surface of a solar reflective material such as a metalized fabric. This allows a user to selectively detach the ground mat, invert the towel assembly, and lay upon the lower towel surface in order to provide an enhanced tanning experience.

Yet still another object of the present invention is to provide secure upright containment of food and drink items using a food/drink platform. The food/drink platform comprises a molded plastic tray including a plurality of recessed drink holder pockets and a flat upper surface. The platform can be removably secured to the towel assembly by utilizing an integral hook-and-loop-type fastener.

Yet still another object of the present invention is to provide a method of utilizing the device that provides a unique means of procuring a model of the apparatus having a desired color or pattern as well as dimensions; attaching the ground mat to the lower towel surface using the hook-and-loop-type fasteners if a ground surface is wet or dirty; placing the apparatus on the ground surface; securing the apparatus to the ground surface by inserting the stakes through aligned pairs of grommets in the towel assembly and ground mat; driving the stakes into the ground surface using the mallet until the stake head of each stake is flush with the top surface of the towel assembly; utilizing the apparatus for sunbathing, resting, or the like, upon a ground surface; benefiting from a beach towel apparatus protected from disturbances brought on by conditions such as wind; loading personal items into one (1) or more pouches; loading sand or weights into one (1) or more of the pouches as needed; closing the zippers to secure the contents of the pouches; attaching the food/drink platform to a side portion of the towel assembly using respective hook-and-loop-type fastener portions; and, utilizing said food/drink platform to safely position drinks and food items.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
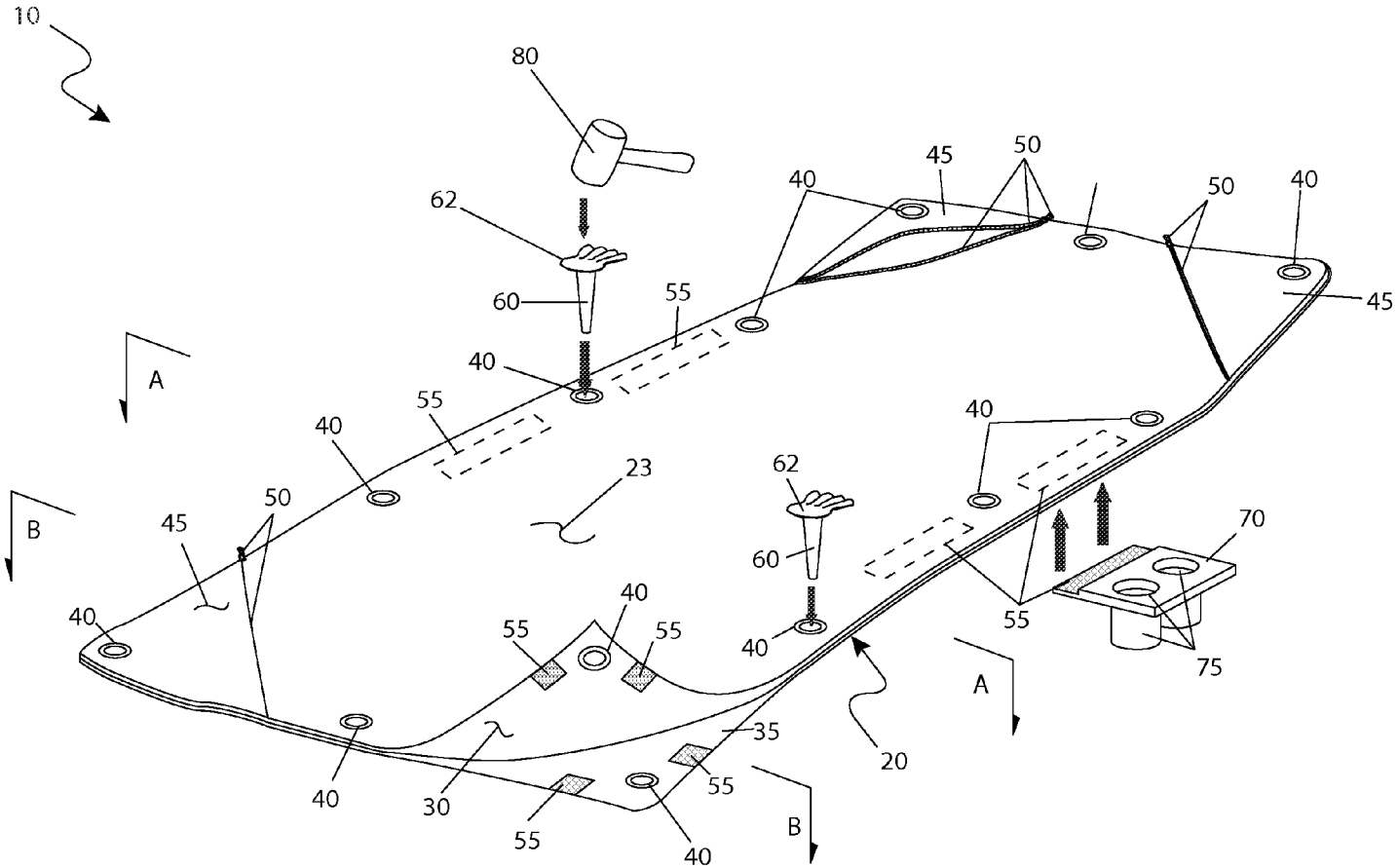
FIG. 1 is a perspective view of a beach towel with anchoring means 10, according to a preferred embodiment of the present invention.

| | |
|---|---|
| 10 | beach towel with anchoring means |
| 20 | towel assembly |
| 23 | upper towel surface |
| 25 | batting layer |
| 30 | lower towel surface |
| 35 | ground mat |
| 40 | grommet |
| 45 | pouch |
| 50 | zipper |
| 55 | hook-and-loop-type fastener |
| 60 | stake |
| 62 | stake head |
| 70 | food/drink platform |
| 75 | drink holder pocket |
| 80 | mallet |
| 100 | ground surface |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a beach towel with anchoring means (herein described as the "apparatus") 10, to stabilize the apparatus 10 against dislodging conditions such as wind. The apparatus 10 resembles a large terry-cloth towel similar to those commonly used at a beach, at a park, or on lounge chairs, and comprises a plurality of grommets 40 located at corner and along perimeter edge portions. Each circular grommet 40 comprises a central aperture portion which insertingly receives a stake 60, thereby holding the towel assembly 20 securely to a ground surface 100. The apparatus 10 comprises a multi-layered machine-washable towel assembly 20 further comprising a conventional terry-cloth upper towel surface 23, an internal cushioning batting layer 25, a reflective lower towel surface 30, and a removably attachable ground mat 35 which provides waterproof protection to said towel assembly 20 when needed. The towel assembly 20 also comprises zippered corner pouches 45 that provide a convenient storage means and are made using a bright-colored and/or reflective textile material to aid in easy identification of the apparatus 10 from a distance. Said pouches 45 may be utilized to store various personal items associated with a beach excursion or may be alternately filled with sand or other heavy objects to provide additional anchoring to further stabilize the apparatus 10.

Referring now to FIG. 1, a perspective view of the apparatus 10, according to the preferred embodiment of the present invention, is disclosed. The apparatus 10 comprises a towel assembly 20 and a ground mat 35. The towel assembly 20 comprises an upper towel surface 23 and a lower towel surface 30. Said towel assembly 20 is removably attached to the ground mat 35 via a plurality of integrally sewn-on hook-and-loop fasteners 55. Both the towel assembly 20 and the ground mat 35 comprise a plurality of correspondingly positioned anchoring grommets 40 arranged in an equally-spaced manner at corner locations and along a perimeter edge area. The upper towel surface 23 further comprises four (4) triangle-shaped pouches 45 located at each corner area. The towel assembly 20 is envisioned to be made using common textile materials utilizing conventional textile sewing techniques common in the industry. It is envisioned that the apparatus 10 may be introduced having towel assemblies 20 of different sizes, ranging from a small single occupant size, up to and including, a large family or group size, and as such should not be interpreted as a limiting factor of the apparatus 10.

The grommets 40 provide a stable anchoring means to the apparatus 10 and are used in conjunction with a plurality of corresponding stakes 60. The grommets 40 are envisioned to be made using corrosion-resistant plastic or metal materials and are permanently affixed to corner and edge regions of said towel assembly 20 and ground mat 35 using common fabrication techniques such as, but not limited to: plastic welding, swaging, adhesives, or the like. Each grommet 40 comprises a center opening portion approximately one (1) inch in diameter being suitable to receive a corresponding stake 60 through. Each stake 60 is envisioned to be made using corrosion-resistant plastic or light-weight metal materials and is approximately eight (8) inches long. Each stake 60 further comprises an over-sized integrally-molded stake head portion 62 at a top portion which extends perpendicularly outward to hold and stabilize the apparatus 10 against the ground surface 100. The stake head 62 is envisioned to take a form of a decorative shape such as a seashell, a flower, a geometric shape, or the like.

The removable ground mat 35 provides waterproof protection to the towel assembly 20 from wet or dirty ground surfaces 100. Said ground mat 35 comprises similar length and width dimensions as the towel assembly 20 and is envisioned being made of durable waterproof plastic or rubber sheet materials. The ground mat 35 further provides a removably attachable means to a bottom surface of said towel assembly 20 via a plurality of hook-and-loop fasteners 55 such as VELCRO®, arranged along a perimeter edge of an upper surface of said ground mat 35 which attach in a normal manner to corresponding hook-and-loop fasteners 55 mounted to the lower towel surface 30 of the towel assembly 20 in like manner.

Figure 2:
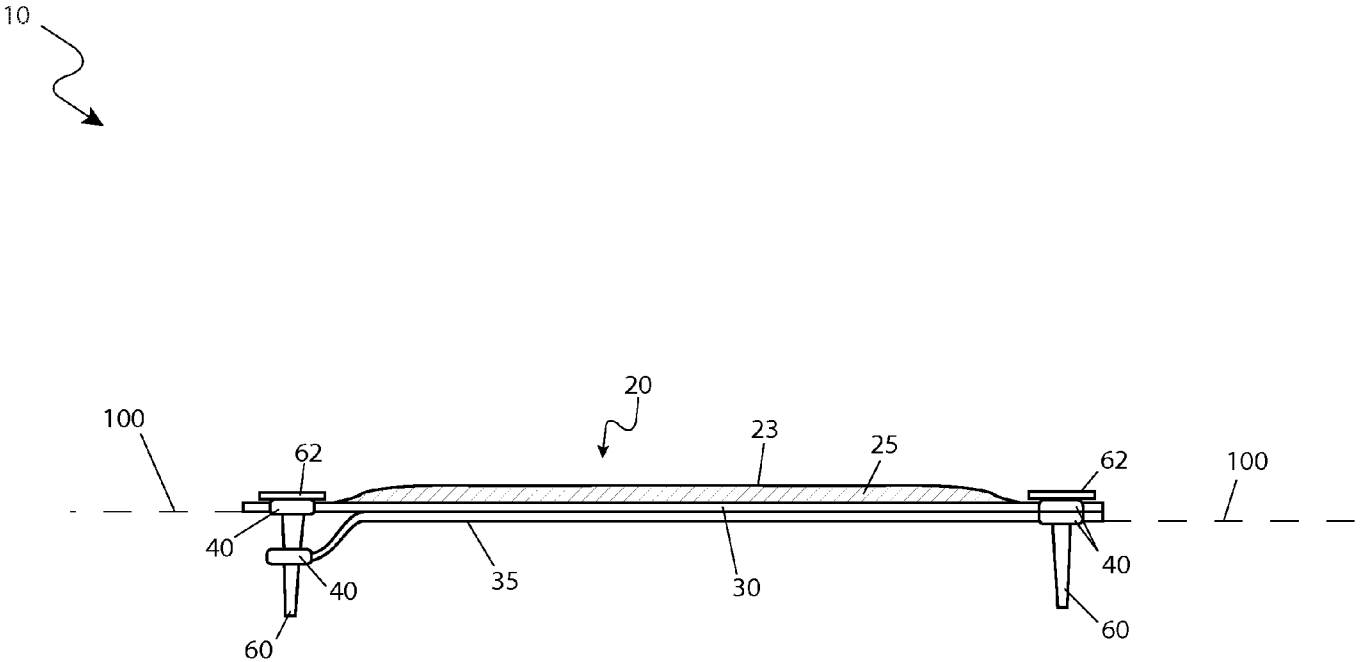
FIG. 2 is a section view taken along section line A-A (see FIG. 1) of the beach towel with anchoring means 10, according to a preferred embodiment of the present invention.

Referring now to FIG. 2, a section view of the apparatus 10 taken along section line A-A (see FIG. 1), according to the preferred embodiment of the present invention, is disclosed. The apparatus 10 comprises an upper absorbent towel surface 23, an internal cotton or polyester batting layer 25 which provides additional padding, and a lower reflective towel surface 30. Said upper towel surface 23, batting layer 25, and lower towel surface 30 are envisioned to be bonded or sewn together forming a permanently assembled and cushioned lamination using conventional bonding and sewing textile assembly techniques. The upper towel surface 23 is to provide a comfortable and moisture-absorbent fabric surface on which a user may sit or lay upon. The upper towel surface 23 is preferably made using a terry-cloth material or may utilize other equivalent natural or synthetic fabrics. The upper towel surface 23 is envisioned being provided in various attractive colors and patterns having a variety of printed or embroidered indicia incorporated onto, based upon a user's preferences. The lower towel surface 30 provides a solar reflection means via a highly reflective and/or metalized smooth fabric surface allowing a user to reverse the towel assembly 20 when desired, thereby enabling said user to lie upon the lower towel surface 30 to provide an enhanced tanning experience.

Figure 3:
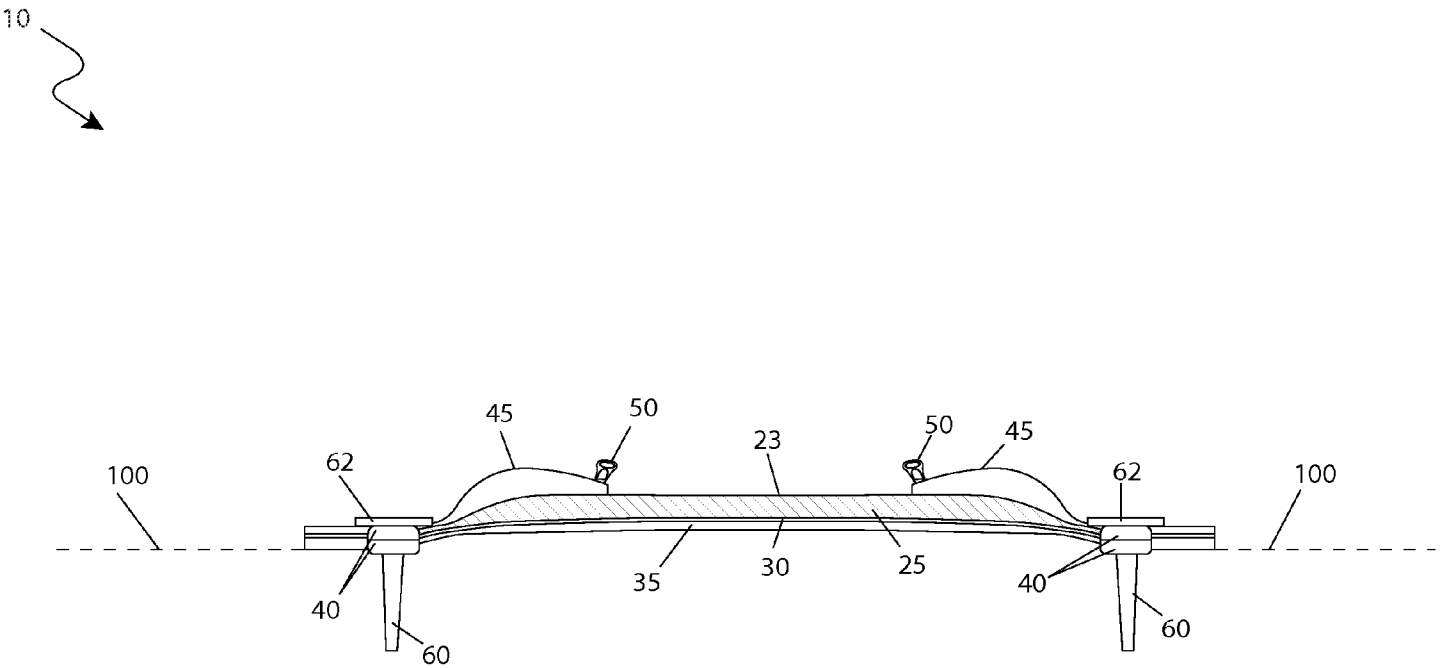
FIG. 3 is a section view taken along section line B-B (see FIG. 1) of the beach towel with anchoring means 10, according to a preferred embodiment of the present invention.

Referring now to FIG. 3 a section view of the apparatus 10 taken along section line B-B (see FIG. 1), according to the preferred embodiment of the present invention, is disclosed. The reflective corner pouches 45 provide a convenient storage means as well as aiding in quick identification of the apparatus 10 from a distance. The pouches 45 are envisioned to comprise a colorful triangle-shape enclosures being located at each corner area of said towel assembly 20. Each pouch 45 is also envisioned to comprise an inwardly-facing zipper 50, thereby securely concealing personal items discreetly within. Said pouches 45 may also be filled with sand or weights, thereby providing an alternate anchoring means to stabilize the apparatus 10.

Figure 4:
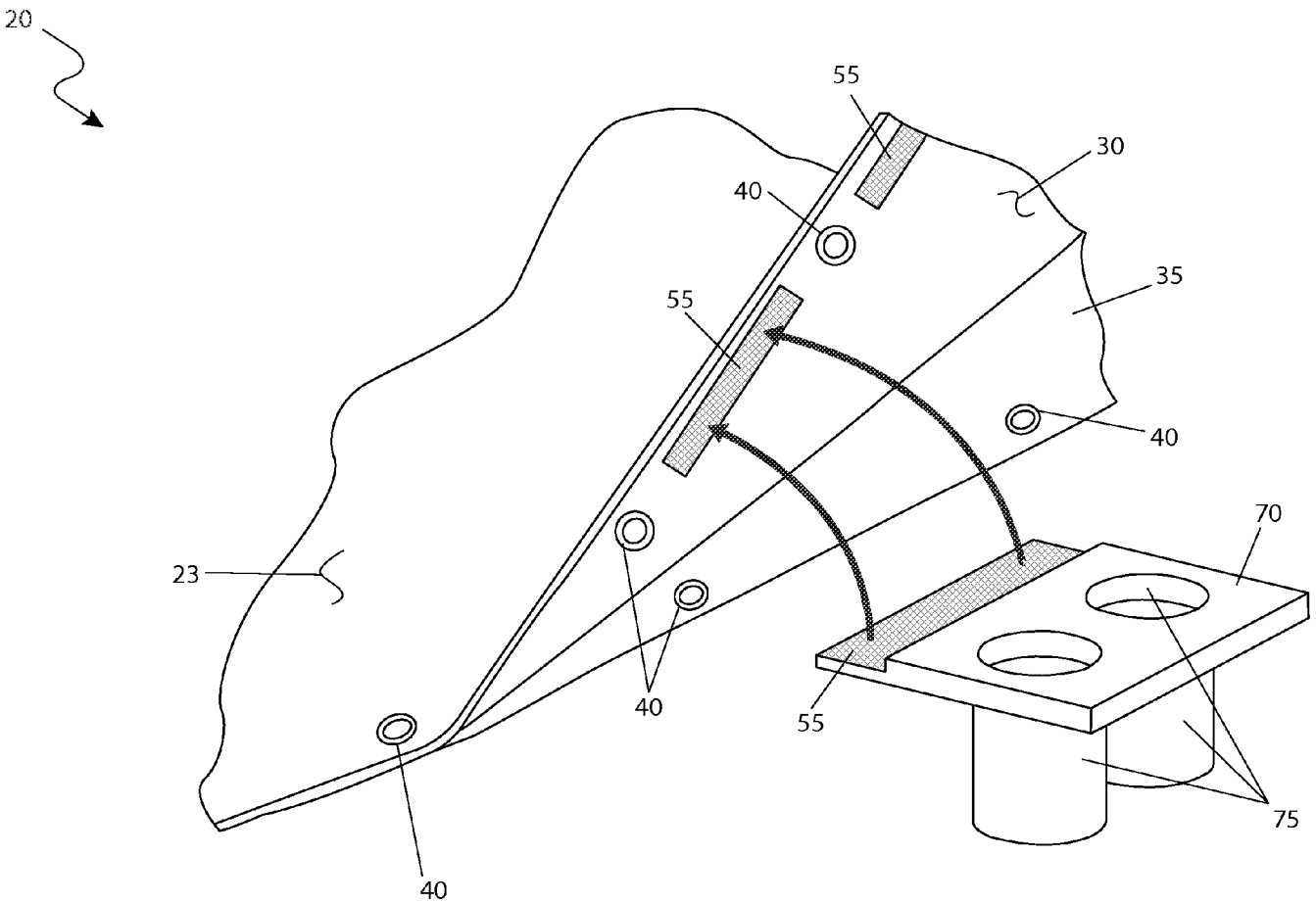
FIG. 4 is a close-up view of a food/drink platform portion of the beach towel with anchoring means 10, according to a preferred embodiment of the present invention.

The apparatus 10 is envisioned to also provide a number of accessory features such as, but not limited to: a mallet 80 or similar driving tool to drive the stakes 60 into a ground surface 100; various printed indicia displaying logos, figures, pictures, or the like; and, a food/drink platform 70 (see FIG. 4).

Referring now to FIG. 4, a close-up view of a food/drink platform portion 70 of the apparatus 10, according to a preferred embodiment of the present invention, is disclosed. The food/drink platform 70 provides a convenient rectangular molded plastic appendage approximately one (1) foot square, to safely hold food and drink items. Said food/drink platform 70 provides removable attachment to a bottom surface of the towel assembly 20 along an edge portion, via corresponding integral hook-and-loop fastener portions 55 affixed to said towel assembly 20 and an edge portion of said food/drink platform 70. Said food/drink platform 70 comprise a unitary plastic molded accessory portion further comprising a washable semi-rigid rectangular plastic platform further comprising having a pair of integrally-molded and recessed cylindrical drink holder pockets 75 and a flat upper surface providing a sufficient area so as to place various food items upon.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: procuring a model of the apparatus 10 having a desired color or pattern as well as desired length and width dimensions; placing the apparatus 10 upon a generally level ground surface 100 at a beach, a park, an athletic event grounds, or the like; attaching the ground mat 35 to the lower towel surface 30 of the towel assembly 20 using the perimeter hook-and-loop fasteners 55, if said ground surface 100 is wet or dirty; securing the apparatus 10 to the ground surface 100 by inserting the stakes 60 through aligned pairs of grommets 40 upon said towel assembly 20 and said ground mat 35; driving the stakes 60 into the ground surface 100 using the mallet 80 until the stake head portion 62 of each stake 60 is flush with the top surface of the towel assembly 20; utilizing the apparatus 10 for sunbathing, resting, or the like, upon a ground surface 100; and, benefiting from a beach towel apparatus 10 being securely affixed to a ground surface 100, thereby being protected from disturbances brought on by conditions such as wind, while using the present invention 10.

The pouch portions 45 of the towel assembly 20 may also be utilized by performing the following steps: loading personal items into one (1) or more pouches 45 by opening one (1) or more respective zipper portions 50; and, loading personal items, food items, drink items, and the like, into said pouches 45 as desired.

The pouch portions 45 may also be utilized to stabilize the apparatus 10 by loading sand or weights into one (1) or more of said pouches 45, as needed, during disrupting conditions such as windy conditions or the like. The pouches 45 are then closed using the zippers 50 to secure the contents.

The food/drink platform portion 70 of the apparatus 10 may be utilized by performing the following steps: attaching said food/drink platform 70 to a side portion of the towel assembly 20 using respective hook-and-loop fastener portions 55; and, utilizing said food/drink platform 70 to safely position drinks and food items.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A towel with an anchoring means;

a generally rectangular towel assembly, comprising a plurality of pouches affixed to an upper surface thereof;

said anchoring means each removably securing said towel assembly to a ground surface;

a pouch located at each corner of said towel assembly and disposed inwardly on said upper surface;

a ground mat removably attachable to a bottom surface of said towel assembly via a plurality of ground mat fasteners removably fastened to a plurality of first towel fasteners; and, a food and drink platform removably disposed between said ground mat and said towel assembly via a plurality of platform fasteners removably fastened to a plurality of second towel fasteners, further comprising:

a generally rectangular semi-rigid platform having said plurality of platform fasteners disposed along a first side thereof; and, at least one cup holder downwardly depending from a central location of said platform;

wherein each of said plurality of pouches further comprises a removable pouch fastener to provide access to an interior thereof;

wherein each of said plurality of pouches retains contents therein;

wherein each pouch is triangular in shape, such that said pouch fastener is located on a perimeter corner edge of said towel assembly and an inward seam of said pouch is affixed to said upper surface of said towel assembly;

wherein said ground mat further comprises a weighted material of construction; and, wherein said ground mat is waterproof.

2. The towel of claim 1, wherein said pouch further comprises a reflective surface on an outer surface thereof.

3. The towel of claim 1, wherein said towel assembly further comprises a machine-washable material.

4. The towel of claim 2, wherein said material is terry cloth.

5. The towel of claim 1, further comprising a plurality of grommets located adjacent to a perimeter edge of said towel assembly for receiving said anchoring means therethrough.

6. The towel of claim 5, wherein at least one of said plurality of grommets are located at each corner of said towel assembly and are disposed through said pouch.

7. The towel of claim 1, wherein said anchoring means further comprises a stake with a decorative head at an upper end thereof;

wherein said decorative head clamps said towel assembly between said decorative head and said ground surface to secure said towel assembly.

8. The towel of claim 1, wherein said plurality of ground mat fasteners, said plurality of platform fasteners, said plurality of first towel fasteners, and said plurality of second towel fasteners comprise corresponding hook-and-loop-type fasteners.

9. A towel with an anchoring means;

a generally rectangular multi-layered towel assembly, further comprising:

an upper absorbent fabric layer;

a lower reflective layer affixed about an entire perimeter edge to said upper absorbent fabric layer;

a plurality of first towel fasteners located adjacent to a perimeter edge of a bottom surface of said lower reflective layer;

a plurality of second towel fasteners located adjacent to a perimeter edge of a bottom surface of said lower reflective layer;

an internal cushioning layer disposed between said upper absorbent layer and said lower reflective layer; and, a plurality of pouches affixed to an upper surface of said upper absorbent layer;

a ground mat removably attachable to a bottom surface of said lower reflective layer assembly via a plurality of ground mat fasteners removably fastened to said plurality of first towel fasteners;

said anchoring means each removably securing said towel assembly to a ground surface; and, a food and drink platform removably disposed between said ground mat and said towel assembly via a plurality of platform fasteners removably fastened to said plurality of second towel fasteners, further comprising:

a generally rectangular semi-rigid platform having said plurality of platform fasteners disposed along a first side thereof; and, at least one cup holder downwardly depending from a central location of said platform;

wherein said lower reflective layer provides solar reflective properties;

wherein each of said plurality of pouches further comprises a removable pouch fastener to provide access to an interior thereof;

wherein each of said plurality of pouches retains contents therein; and, wherein said ground mat further comprises a weighted material of construction; and, wherein said ground mat is waterproof.

10. The towel of claim 9, further comprising a pouch located at each corner of said towel assembly and disposed inwardly on said upper surface;

wherein each pouch is triangular in shape, such that said pouch fastener is located on a perimeter corner edge of said towel assembly and an inward seam of said pouch is affixed to said upper surface of said towel assembly.

11. The towel of claim 10, wherein said pouch further comprises a reflective surface on an outer surface thereof.

12. The towel of claim 10, wherein said upper absorbent layer further comprises terry cloth.

13. The towel of claim 10, wherein said lower reflective layer further comprises a highly reflective or metalized smooth fabric surface.

14. The towel of claim 10, further comprising a plurality of grommets located adjacent to a perimeter edge of said towel assembly for receiving said anchoring means through.

15. The towel of claim 14, wherein at least one of said plurality of grommets are located at each corner of said towel assembly and are disposed through said pouch.

16. The towel of claim 10, wherein said anchoring means further comprises a stake with a decorative head at an upper end thereof;

wherein said decorative head clamps said towel assembly between said decorative head and said ground surface to secure said towel assembly.

17. The towel of claim 10, wherein said plurality of ground mat fasteners, said plurality of platform fasteners, said plurality of first towel fasteners, and said plurality of second towel fasteners comprise corresponding hook-and-loop-type fasteners.

* * * * *